US007270498B1

(12) United States Patent
Albanese

(10) Patent No.: US 7,270,498 B1
(45) Date of Patent: Sep. 18, 2007

(54) FLOOD VENT

(76) Inventor: Andrew Albanese, 356 Neptune Dr., Manahawkin, NJ (US) 08050

( * ) Notice: Subject to any disclaimer, the term of this patent is extended or adjusted under 35 U.S.C. 154(b) by 0 days.

(21) Appl. No.: 11/635,556

(22) Filed: Dec. 8, 2006

Related U.S. Application Data

(60) Provisional application No. 60/812,104, filed on Jun. 9, 2006.

(51) Int. Cl.
*E02B 7/26* (2006.01)

(52) U.S. Cl. ..... 405/104; 405/103; 405/96; 405/92; 52/1; 52/302.1

(58) Field of Classification Search ..... 405/87–92, 405/96, 103, 104; 52/1, 167.1, 302.1, DIG. 12
See application file for complete search history.

(56) References Cited

U.S. PATENT DOCUMENTS

| | | | | |
|---|---|---|---|---|
| 3,096,816 | A * | 7/1963 | Peters | 160/215 |
| 3,221,504 | A | 12/1965 | Turner | |
| 3,287,918 | A * | 11/1966 | Stewart | 405/104 |
| 3,861,081 | A * | 1/1975 | Maskell | 405/104 |
| 3,953,978 | A | 5/1976 | Soileau | |
| 4,689,926 | A | 9/1987 | McDonald | |
| 4,726,709 | A * | 2/1988 | Labelle | 405/104 |
| 5,460,462 | A * | 10/1995 | Regan | 405/96 |
| 5,944,445 | A | 8/1999 | Montgomery | |
| 6,287,050 | B1 | 9/2001 | Montgomery et al. | |
| 6,338,594 | B1 * | 1/2002 | Adler et al. | 405/92 |
| 6,481,156 | B1 * | 11/2002 | Richmond | 49/360 |
| 6,485,231 | B2 | 11/2002 | Montgomery et al. | |
| 6,623,209 | B1 * | 9/2003 | Waters, Jr. | 405/94 |
| 6,691,463 | B1 * | 2/2004 | Richmond | 49/360 |
| 6,692,187 | B2 | 2/2004 | Sprengle, Sr. et al. | |
| 6,732,479 | B2 * | 5/2004 | Nomura et al. | 405/87 |
| 2002/0021941 | A1 | 2/2002 | Montgomery et al. | |
| 2003/0082008 | A1 | 5/2003 | Sprengle et al. | |

FOREIGN PATENT DOCUMENTS

| | | |
|---|---|---|
| EP | 1441102 | 7/2004 |
| GB | 2303163 | 2/1997 |

OTHER PUBLICATIONS www.smartvent.com "Smart Vent" website, retrieved on Apr. 13, 2006.
www.floodex.net/pages/1/index.htm "Floodex Flood Vent Systems" website, retrieved on Apr. 13, 2006.

* cited by examiner

*Primary Examiner*—Frederick L. Lagman
(74) *Attorney, Agent, or Firm*—Richard C. Litman

(57) ABSTRACT

The flood vent has an elongated box-shaped frame having a top end, a bottom end including a floor, and opposing sidewalls that define a fluid passageway. The frame has an open front and a track formed in the rear of the frame. A door is slidably mounted in the track so that a normally closed position blocks the fluid passageway. The door is sufficiently buoyant to permit floodwater to float the door in the track and, thus, to automatically vent excess water through the fluid passageway. Installed in a crawl space, basement, or similar structure, the venting action of the flood vent limits hydrostatic pressure buildup against the walls of the structure when floodwaters rise, thus preventing structural damage from occurring.

14 Claims, 3 Drawing Sheets

FLOOD VENT

CROSS-REFERENCE TO RELATED APPLICATION

This application claims the benefit of U.S. Provisional Patent Application Ser. No. 60/812,104, filed Jun. 9, 2006.

BACKGROUND OF THE INVENTION

1. Field of the Invention

The present invention relates to crawl space and basement venting, and in particular, to a flood vent that opens to permit the flow of water through a crawl space or foundation level of a building in a flood area when the water level rises in order to avoid excessive hydrostatic pressure against the exterior walls of the structure that might cause the walls to collapse or cave in.

2. Description of the Related Art

To help limit flooding damage, several building code organizations and the federal government have promulgated regulations that mandate that buildings with enclosed spaces located below base flood plain levels, such as crawl spaces, must provide for automatic equalization of interior and exterior hydrostatic forces caused by rising floodwaters.

According to these regulations, flooding fluids must be permitted to enter and exit the enclosed spaces freely. Such regulations often require builders to install a number of vents in the enclosed spaces. For example, federal regulations promulgated by the Federal Emergency Management Agency (FEMA) require flood venting for the release of hydrostatic water pressure in new construction where the site has been designated as a flood-prone area. For example, a sealing device against flooding is disclosed in European Patent No. 1,441,102, published Jul. 28, 2004, which describes a device including two sheet panels having foam joints to ensure sealing. The device appears to operate more like a storm window than a flood vent and does not appear to address the aforementioned problems.

Additionally, it is common practice to use air vents to permit humid air to escape from crawl spaces, basements, and the like. Therefore, it would be desirable to provide a flood vent with integrated air vents, yet having a minimal number of moving parts.

Thus, a flood vent solving the aforementioned problems is desired.

SUMMARY OF THE INVENTION

The flood vent comprises an elongated box-shaped frame having a top end, a bottom end including a floor, and opposing sidewalls that define a fluid passageway. A door is slidably mounted in the rear of the frame so that a normally closed position blocks the fluid passageway. The door is sufficiently buoyant to permit tidal water to float the door and, thus, to automatically vent excess water through the fluid passageway. Installed in a crawl space, basement, or similar structure, the venting action of the flood vent limits hydrostatic pressure buildup when floodwaters rise, thus preventing structural damage from occurring.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1A:
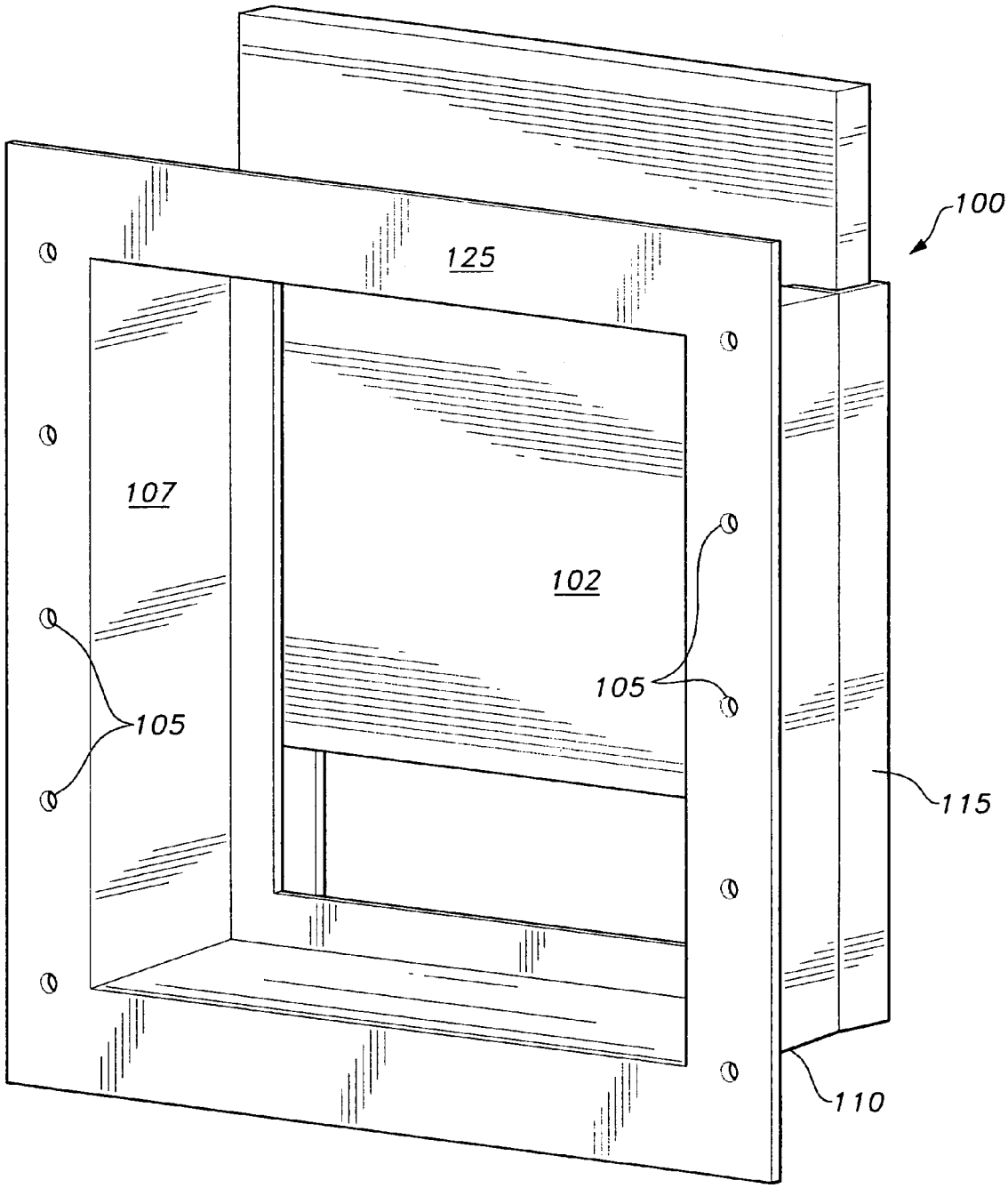
FIG. 1A is a perspective view of a flood vent according to the present invention.
Figure 1B:
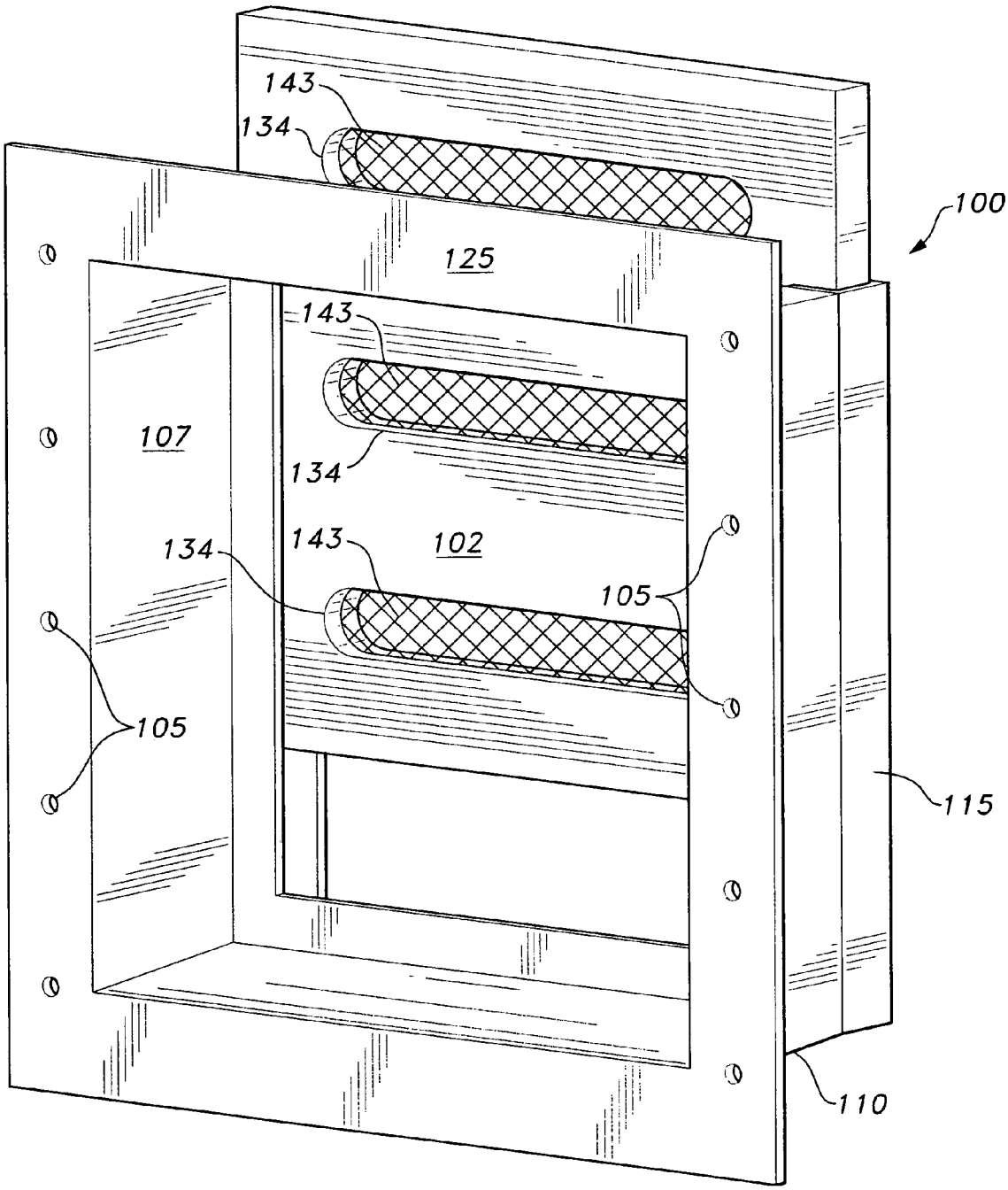
FIG. 1B is a perspective view of an embodiment of a flood vent according to the present invention with air vents incorporated therein.
Figure 2:
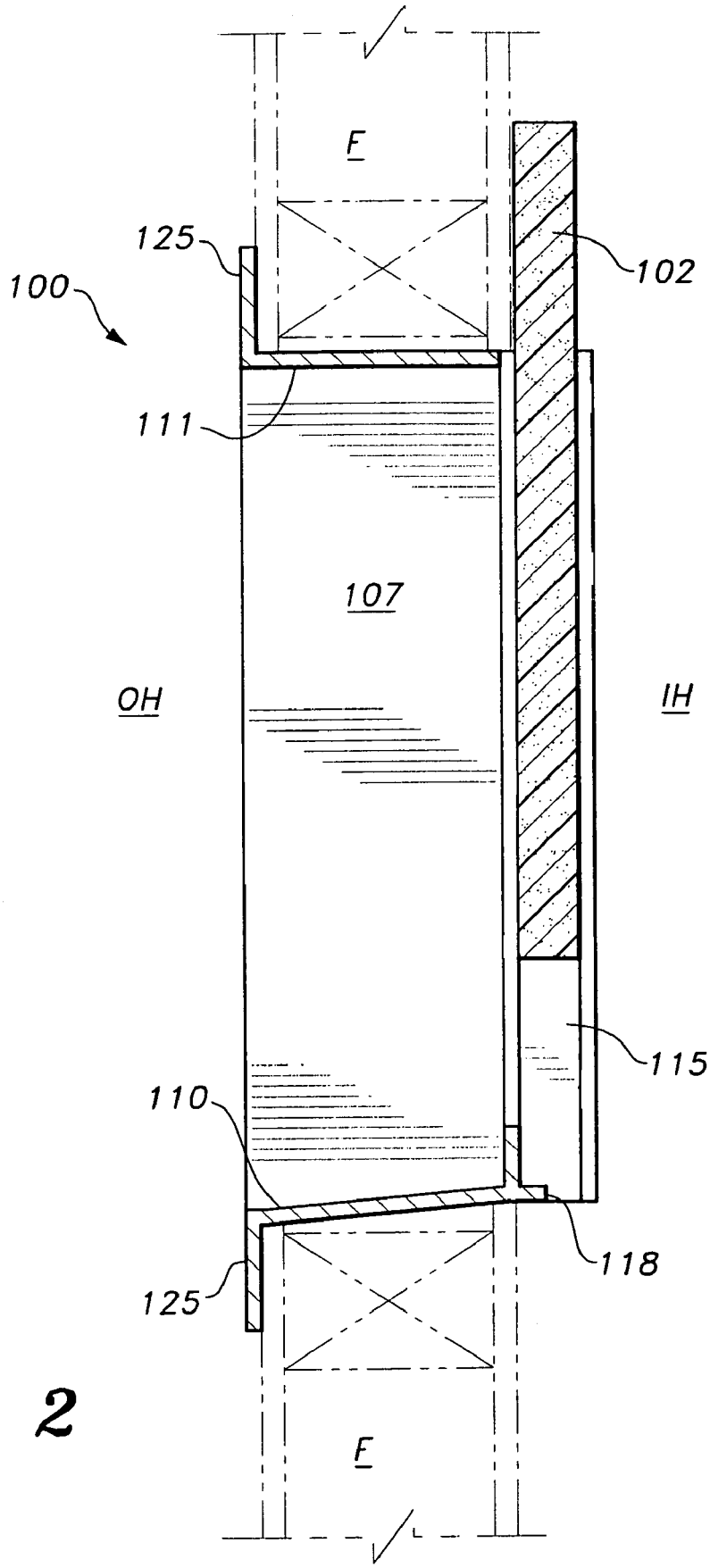
FIG. 2 is a side view in section of a flood vent according to the present invention.

As shown in FIGS. 1A through 2, the present invention is a flood vent 100 that comprises a box-shaped frame having a top end 111, a bottom end 110, and opposing sidewalls 107 that define a cavity, i.e., a fluid passageway. A door 102 is slidably attached to the rear of the frame so that a normally closed position blocks the fluid passageway. The slidable attachment is formed by vertical flange members 115 being disposed on the rear of the frame laterally. The vertical flange members 115 are U-shaped members that form two vertical channels or tracks within which the door 102 is slidable. The front of the frame is open. The top end 111 of the frame may have a ceiling, or may be open.

The door 102 is dimensioned so that it can freely slide within, yet is laterally constrained by, the vertical flange members 115. A retaining lip 118 is disposed end-to-end laterally across the bottom 110 of the frame at the rear of the frame. The retaining lip 118 is dimensioned to project rearward only partially into the channel or track defined by U-shaped flanges 115, while leaving a gap between the retaining lip 118 and the rear of the channel formed by vertical flange members 115 in order to vertically support an attached door 102, while allowing a rising fluid level to contact a bottom surface of the door 102, and also forming a stop to prevent the door 102 from sliding out of the track formed by flanges 115. The door 102 may have a laterally extending ridge (not shown) disposed along a bottom section of the door 102 that can come in contact with a stationary upper portion of the flood vent 100 proximate top end 111 to prevent the door 102 from escaping the track 115 during exceedingly high water levels.

The door 102 is sufficiently buoyant to permit floodwater to float the door 102 and, thus, to automatically vent excess water through the fluid passageway. For example, the door 102 may be made of a polymeric foam compound, such as styrofoam or the like. Alternatively, a buoyant float (not shown) may be connected to the door. A visually and/or esthetically pleasing coating may be disposed on the surfaces of the door 102 to blend in with a coloring of the remainder of the flood vent 100. As shown in FIG. 2, air vent openings 134 may optionally be defined in the door. An air permeable mesh 143 may be disposed in air vent openings 134 in order to protect against debris, animals, and the like from passing through the air vent openings 134.

As shown in FIG. 2, a rectangular nailing flange 125 is disposed around the front of the flood vent 100. The nailing flange has pilot holes 105 to facilitate attachment of the flood vent 100 to the framing F of a building structure. When properly installed, the front of the flood vent 100 faces outside OH of the building structure, while the rear of the flood vent 100 is disposed inside IH the building structure, the rear of the frame, or at least the track formed by U-shaped flanges 115, extending beyond the inner surface of the exterior foundation wall so that door 102 is free to float upward in the track. A rising water level in the vent 100 causes the buoyant door 102 to rise inside the vertical flange members 115 to permit flood waters to enter the building or crawl space, thus mitigating or avoiding hydrostatically induced structural damage to the building structure. The floor at the bottom end 110 of the flood vent 100 may have a pitch, i.e., may slope upward from front to rear so that the flood waters may recede out though the front opening of the flood vent 100 as the water level falls.

The flood vent 100 may be scaled to any size and used in any number to provide a required area of flood ventilation coverage to comply with Federal Emergency Management Agency (FEMA) regulations. The flood vent 100 may be installed in either wood frame or masonry units. The frame of the flood vent 100 made from a variety of materials, including, but not limited to, polymeric compound, stainless steel, aluminum, and the like.

Installed in a crawl space, basement, or similar structure, the fluid venting action of the flood vent 100 limits hydrostatic pressure buildup when the structure becomes flooded, thus preventing structural damage from occurring.

It is to be understood that the present invention is not limited to the embodiment described above, but encompasses any and all embodiments within the scope of the following claims.

I claim:

1. A flood vent, comprising:

an elongated box-shaped frame forming a fluid passageway and having an open front and a track formed laterally in a rear of the frame, the frame being adapted for incorporation into a building wall at foundation level with the open front facing outward and the track being disposed inside the building;

a door slidably disposed in the track, the door being buoyant;

whereby rising floodwaters enter the open front, floating the door to vent floodwaters into the building in order to reduce hydrostatic pressure against the building wall.

2. The flood vent according to claim 1, wherein said door is made from buoyant material.

3. The flood vent according to claim 1, further comprising: a laterally extending ridge disposed along a bottom section of said door, the laterally extending ridge preventing the door from escaping the track during exceedingly high water levels.

4. The flood vent according to claim 1, wherein the laterally formed track comprises two vertically extending flange members disposed in the rear of the frame.

5. The flood vent according to claim 1, further comprising a retaining lip disposed end-to-end laterally across a bottom of the frame at the rear of the frame, the retaining lip projecting rearward partially into the track while leaving a gap between the retaining lip and the rear of the track in order to vertically support an attached door, while allowing a rising fluid level to contact a bottom surface of the door, the retaining lip forming a stop to prevent the door from sliding out of the track.

6. The flood vent according to claim 1, wherein the door is made of a buoyant polymeric foam compound.

7. The flood vent according to claim 1, further comprising a buoyant float connected to the door in order to make the door rise with the rising floodwaters.

8. The flood vent according to claim 1, wherein said door has a plurality of air vent openings defined therein.

9. The flood vent according to claim 8, wherein the air vent openings comprise an air permeable mesh for preventing debris and animals passing through the air vent openings.

10. The flood vent according to claim 1, wherein a nailing flange disposed around the front of the frame.

11. The flood vent according to claim 10, wherein the nailing flange has pilot holes defined therein to facilitate attachment of the flood vent to framing in the building wall.

12. The flood vent according to claim 1, wherein said frame has a floor pitched upward from the front to rear of the frame in order to allow flood waters to recede at through the front opening as water levels fall.

13. The flood vent according to claim 1, wherein the frame and the door are made from a polymeric compound.

14. The flood vent according to claim 1, wherein the frame is made from metal.

* * * * *